US010104465B2

(12) United States Patent
Nagata et al.

(10) Patent No.: US 10,104,465 B2
(45) Date of Patent: Oct. 16, 2018

(54) HEADPHONE DEVICE

(71) Applicant: JVC KENWOOD Corporation, Yokohama-shi, Kanagawa (JP)

(72) Inventors: Hikaru Nagata, Yokohama (JP); Yuji Yanagishita, Yokohama (JP); Shohei Tanigawa, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 49 days.

(21) Appl. No.: 15/368,880

(22) Filed: Dec. 5, 2016

(65) Prior Publication Data

US 2017/0085975 A1 Mar. 23, 2017

Related U.S. Application Data

(63) Continuation of application No. PCT/JP2015/061471, filed on Apr. 14, 2015.

(30) Foreign Application Priority Data

Jun. 16, 2014 (JP) ..... 2014-123140

(51) Int. Cl.
*H04R 25/00* (2006.01)
*H04R 1/10* (2006.01)
*H04R 5/033* (2006.01)

(52) U.S. Cl.
CPC ..... *H04R 1/105* (2013.01); *H04R 1/1041* (2013.01); *H04R 5/0335* (2013.01);
(Continued)

(58) Field of Classification Search
CPC .... H04R 1/105; H04R 1/1041; H04R 5/0335; H04R 1/1008; H04R 1/1066; H04R 2201/025; H04R 2460/17
(Continued)

(56) References Cited

U.S. PATENT DOCUMENTS

2009/0052716 A1* 2/2009 Yamaguchi ..... H04R 1/1058 381/378
2011/0103635 A1* 5/2011 Asakura ..... H04R 1/1066 381/378

(Continued)

FOREIGN PATENT DOCUMENTS

JP 2013038671 A 2/2013

OTHER PUBLICATIONS

ISA 237 Form dated Jun. 9, 2015 corresponding to International application No. PCT/JP2015/061471.

*Primary Examiner* — Sean H Nguyen
(74) *Attorney, Agent, or Firm* — Nath, Goldberg & Meyer; Jerald L. Meyer

(57) ABSTRACT

A hanger has a support column having a protrusion. The protrusion has a first and a second protrusion formed to be protruding in opposite directions with each other on a second axial line that intersects orthogonally with a first axial line, and a third protrusion formed to be protruding on a third axial line that intersects orthogonally with the first axial line and the second axial line. A link portion has an accommodation portion for engaging and accommodating the protrusion. The hanger is linked with the link portion, such that a revolution within a first prescribed angle range around the first axial line is permitted, and a folding revolution that is a revolution within a second prescribed angle range around the second axial line is permitted when the support column is located at either one of both ends of the first prescribed angle range.

6 Claims, 12 Drawing Sheets

(52) U.S. Cl.
CPC ..... *H04R 1/1008* (2013.01); *H04R 1/1066* (2013.01); *H04R 2201/025* (2013.01); *H04R 2460/17* (2013.01)

(58) Field of Classification Search
USPC ..... 381/383
See application file for complete search history.

(56) References Cited

U.S. PATENT DOCUMENTS

| | | | | |
|---|---|---|---|---|
| 2012/0140973 | A1* | 6/2012 | Olodort ..... | H04R 1/1066<br>381/375 |
| 2014/0205130 | A1* | 7/2014 | Blair ..... | H04R 5/0335<br>381/378 |
| 2014/0241561 | A1* | 8/2014 | Motosugii ..... | H04R 5/0335<br>381/379 |
| 2015/0222980 | A1* | 8/2015 | Pizzaro ..... | H04R 1/1058<br>381/371 |
| 2016/0127819 | A1* | 5/2016 | Shiomi ..... | H04R 1/1033<br>381/378 |
| 2016/0205459 | A1* | 7/2016 | Kamada ..... | H04R 1/1041<br>381/74 |

* cited by examiner

HEADPHONE DEVICE

CROSS REFERENCE TO RELATED APPLICATION

This application is a Continuation of PCT Application No. PCT/JP2015/061471, filed on Apr. 14, 2015, and claims the priority of Japanese Patent Application No. 2014-123140, filed on Jun. 16, 2014, the entire contents of both of which are incorporated herein by reference.

BACKGROUND

The present disclosure relates to a headphone device of an overhead type that can be put in a compact, accommodated form by folding a housing portion with respect to a headband.

Conventionally, in order to improve the accommodation capability of the headphone device of the so-called overhead type, there has been a headphone device that can be put in a compact, accommodated form by folding a pair of housing portions, to be applied to the left and right ears, into an inner side of a curved portion of the headband.

The headphone device disclosed in Japanese Patent Application Publication No. 2013-038671 (Patent Document 1) is capable of folding a respective pair of housing portions into an inner side of a curved portion of the band. Also, the headphone device disclosed in Patent Document 1 is capable of folding a respective pair of housing portions into an inner side of a curved portion of the band, even in a state of being revolved by 90° around an axial line along an extended longitudinal direction of the headband.

According to this structure, the depth of the folded state can be made thinner, so that the accommodation capability is superior.

SUMMARY

The conventional headphone device, as described in Patent Document 1, has a folding mechanism for revolving the housing portions with respect to the headband into an inner side of a curved portion of the band, and a revolving mechanism for revolving the housing portions around an axial line along an extended longitudinal direction of the headband, which are provided independently. For this reason, there are a large number of parts and it becomes expensive, so that an improvement is desired.

In addition, the conventional headphone device, as described in Patent Document 1, has a revolution axial line for the folding (which will be referred to as a folding axial line in the following), and an axial line along an extended longitudinal direction of the headband, which are set at different positions along the headband. More specifically, the folding axial line is located closer to the center side of the headband, so that the portion to be folded is made relatively longer.

In this way, in order to prevent mutual interference at the time of folding a pair of housing portions, there arises a constraint to some extent on outward appearance designs of the housing portions and the like, so that an improvement is desired.

An aspect of the embodiments provides a headphone device including: a headband; a housing portion having a speaker unit, a main body portion accommodating the speaker unit, and a hanger supporting the main body portion; and a link portion to which the hanger is linked at an end portion of the headband.

The hanger includes abase portion, and a support column having a support column base portion provided to be erected from the base portion, and a protrusion formed on a tip-end side of the support column.

The protrusion includes a first protrusion and a second protrusion formed to be protruding in opposite directions with each other on a second axial line that intersects orthogonally with a first axial line, which is an axial line of the support column base portion, and a third protrusion formed to be protruding on a third axial line that intersects orthogonally with the first axial line and the second axial line.

The link portion includes an accommodation portion for engaging and accommodating the protrusion.

The hanger is linked with the link portion, as the protrusion is engaged with and accommodated in the accommodation portion, such that a revolution within a first prescribed angle range around the first axial line of the support column is permitted, and a folding revolution, that is a revolution within a second prescribed angle range around the second axial line of the support column, is permitted when the support column is located at either one of both ends of the first prescribed angle range.

DETAILED DESCRIPTION

A headphone device according to the embodiment will be described using FIG. 1 to FIG. 12 by way of a headphone device 51 that is the preferred example.

Figure 1:
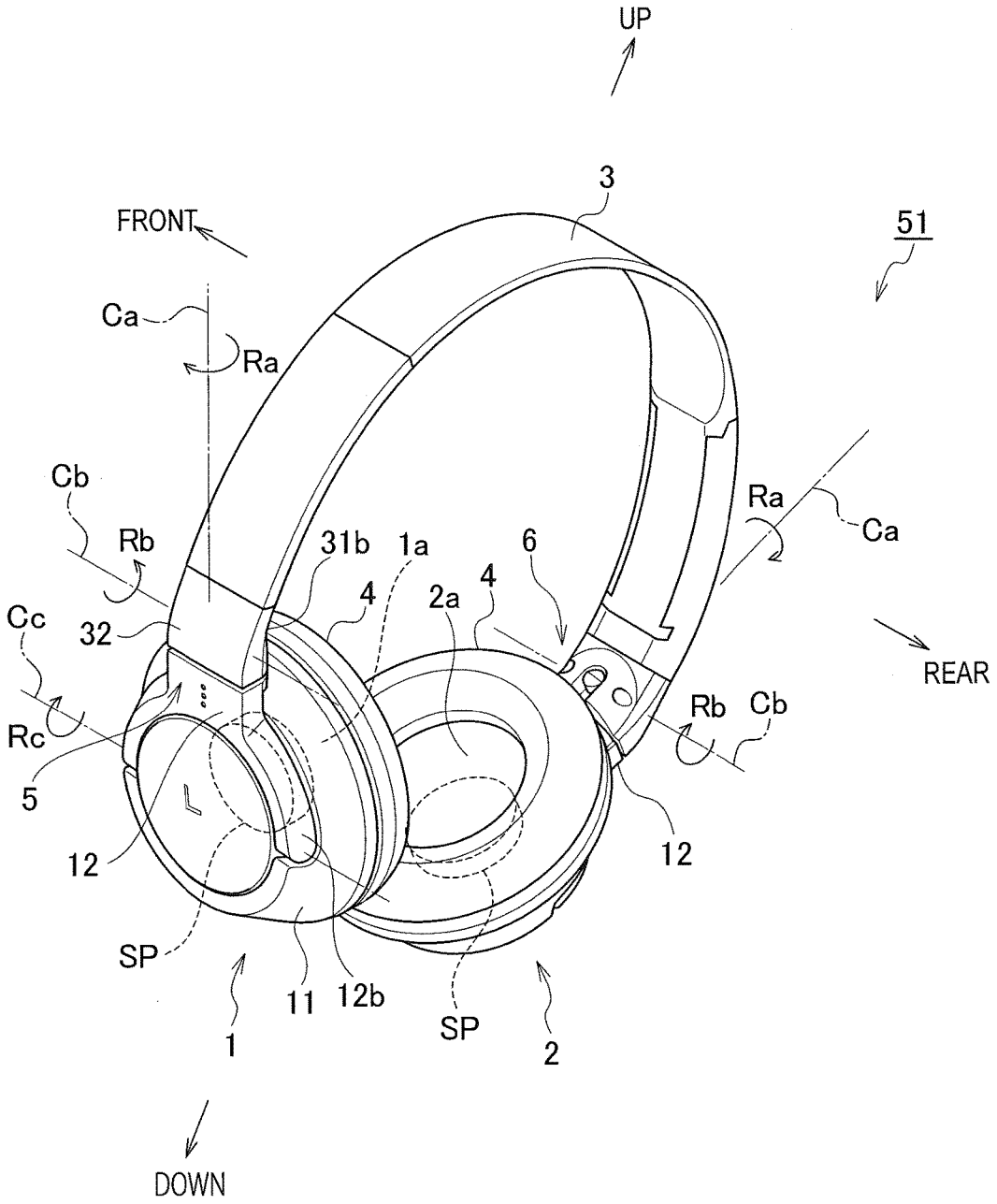
FIG. 1 is a perspective view showing an overall configuration of a headphone device 51 that is an example of a headphone device according to at least one embodiment.

FIG. 1 is a perspective view of an outward appearance showing the headphone device 51. The front/rear and up/down directions shown in FIG. 1 correspond to the front/rear and up/down directions of a user in a state of use in which the headphone device 51 is worn on a head portion.

The headphone device 51 has a housing portion 1 to be applied to a left ear and a housing portion 2 to be applied to a right ear at the time of use, and a curved headband 3 to be linked with the housing portion 1 and the housing portion 2.

Each of the housing portions 1 and 2 accommodates a speaker unit SP. On the sound releasing faces 1*a* and 2*a*, for releasing sounds from the speaker unit SP in the respective housing portions 1 and 2, soft ear pads 4 are mounted.

Figure 2A:
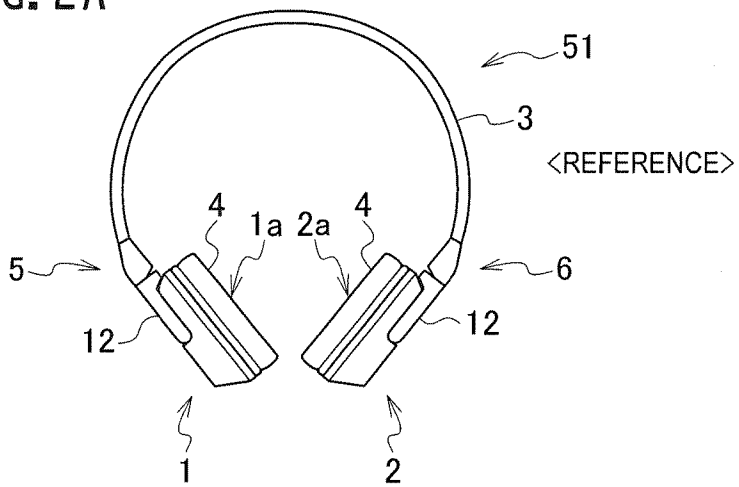
FIG. 2A is a schematic view showing a reference usage posture of the headphone device 51.

FIG. 1 shows a usage posture to be a reference in which the sound releasing faces 1*a* and 2*a* of the housing portions 1 and 2 are roughly facing each other. This posture is schematically shown in FIG. 2A. This posture is a normal usage posture, which will be referred to as a reference usage posture in the following.

Returning to FIG. 1, the housing portions 1 and 2 are linked with the headband 3 by the link portions 5 and 6 via the hangers 12, respectively provided on the housing portions 1 and 2.

The link portion 5 is made to be a two-axes revolution portion for permitting a revolution (arrow Ra) of the housing portion 1 around a revolution axial line Ca that is roughly along an extended longitudinal direction, and a revolution (arrow Rb) of the housing portion 1 around a revolution axial line Cb that is roughly along an extended transverse direction (a width direction), at an end portion of the headband 3 on the link portion 5 side.

The link portion 6 is also made to be a two-axes revolution portion of the similar structure for the housing portion 2.

The revolution axial line Cb is a revolution axial line for folding the housing portions 1 and 2, and will be also referred to as a folding axial line Cb. The revolution around the revolution axial line Cb is a revolution for folding the housing portions 1 and 2, and will be also referred to as a folding revolution.

Next, the two-axes revolution of the housing portions 1 and 2 that is permitted by the link portions 5 and 6 will be described in detail.

Figure 2B:
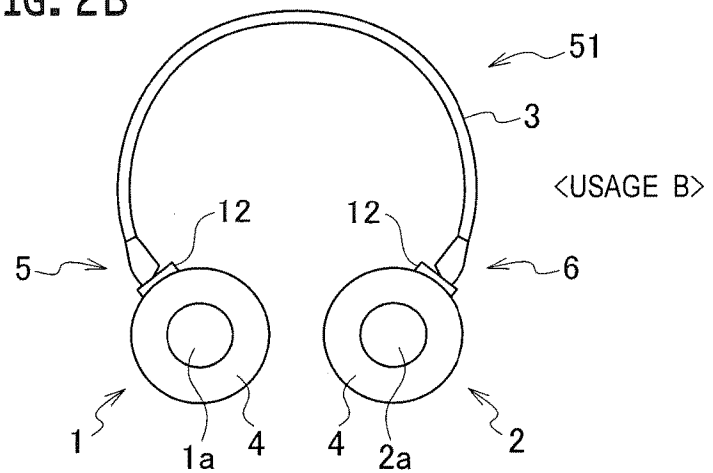
FIG. 2B is a schematic view showing a usage B posture of the headphone device 51.

First, the link portions 5 and 6 are made to be capable of revolving the housing portions 1 and 2 by at least 90° in the Ra direction from the posture shown in FIG. 1, around the revolution axial line Ca. That is, the link portions 5 and 6 can revolve the housing portions 1 and 2 by 90° around the revolution axial line Ca from the state of FIG. 1 and FIG. 2A, to make a posture in which the sound releasing faces 1*a* and 2*a* are facing backwards. This state is shown in FIG. 2B. This state will be referred to as a usage B posture.

Figure 2C:
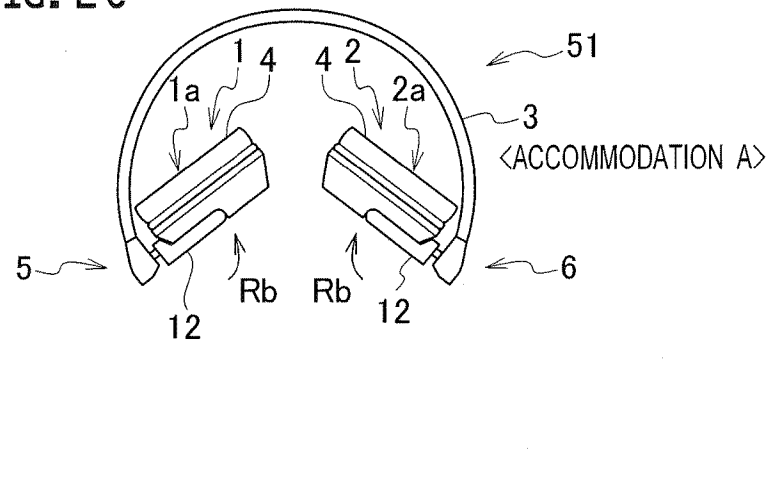
FIG. 2C is a schematic view showing an accommodation A posture of the headphone device 51.

Also, the link portions 5 and 6 are made to be capable of revolving the housing portions 1 and 2 by at least 90° in the Rb direction from the posture shown in FIG. 1, around the folding axial line Cb. That is, the link portions 5 and 6 can make folding revolutions of the housing portions 1 and 2 by 90°, around the folding axial line Cb from the state of FIG. 1 and FIG. 2A, to make a state in which the sound releasing faces 1*a* and 2*a* are facing upwards. This state is shown in FIG. 2C. This state will be referred to as the accommodation A posture.

It is configured such that the revolution around the folding axial line Cb is permitted only when a posture of the housing portions 1 and 2 around the revolution axial line Ca is either the reference usage posture shown in FIG. 1 and FIG. 2A or the usage B posture shown in FIG. 2B, which is revolved by 90°.

Figure 2D:
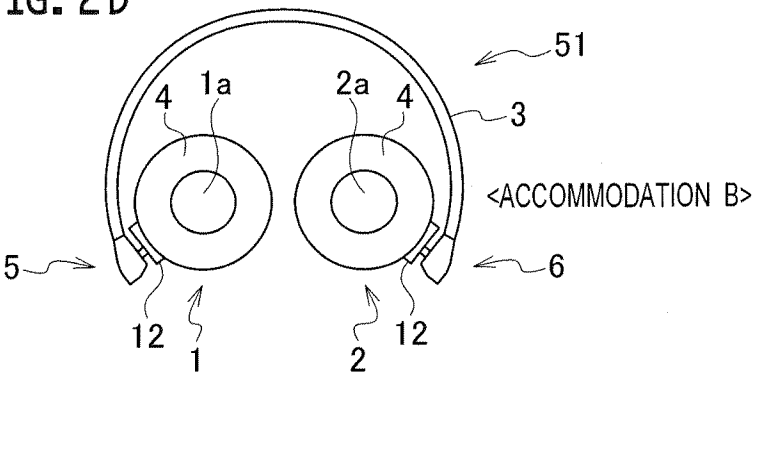
FIG. 2D is a schematic view showing an accommodation B posture of the headphone device 51.

Consequently, it is possible to fold the housing portions 1 and 2 into an inner side of the headband 3 while making the sound releasing faces 1*a* and 2*a* to face backwards, by the 90° folding revolution around the folding axial line Cb from the state shown in FIG. 2B. This state is shown in FIG. 2D. This state will be referred to as the accommodation B posture.

The revolution operations of the housing portions 1 and 2 by the link portions 5 and 6 are symmetrical operations, so that they will be described in detail by taking the link portion 5 and the housing portion 1 as representatives in the following description, and also by referring to FIG. 3 to FIG. 12.

First, in FIG. 1, the housing portion 1 has a main body portion 11 for accommodating the speaker unit SP, which is in an approximately-truncated cone shape, and a hanger 12 for supporting the main body portion 11 to be freely-revolvable, by engaging a Y-shaped arm section to a diameter portion in the front/rear direction of the main body portion 11.

That is, the main body portion 11 is made to be capable of revolving by a prescribed angle (about 90°, for example) in the Rc direction from the posture shown in FIG. 1, around the revolution axial line Cc, by the hanger 12.

FIG. 3 to FIG. 12 are the following drawings.

Figure 3:
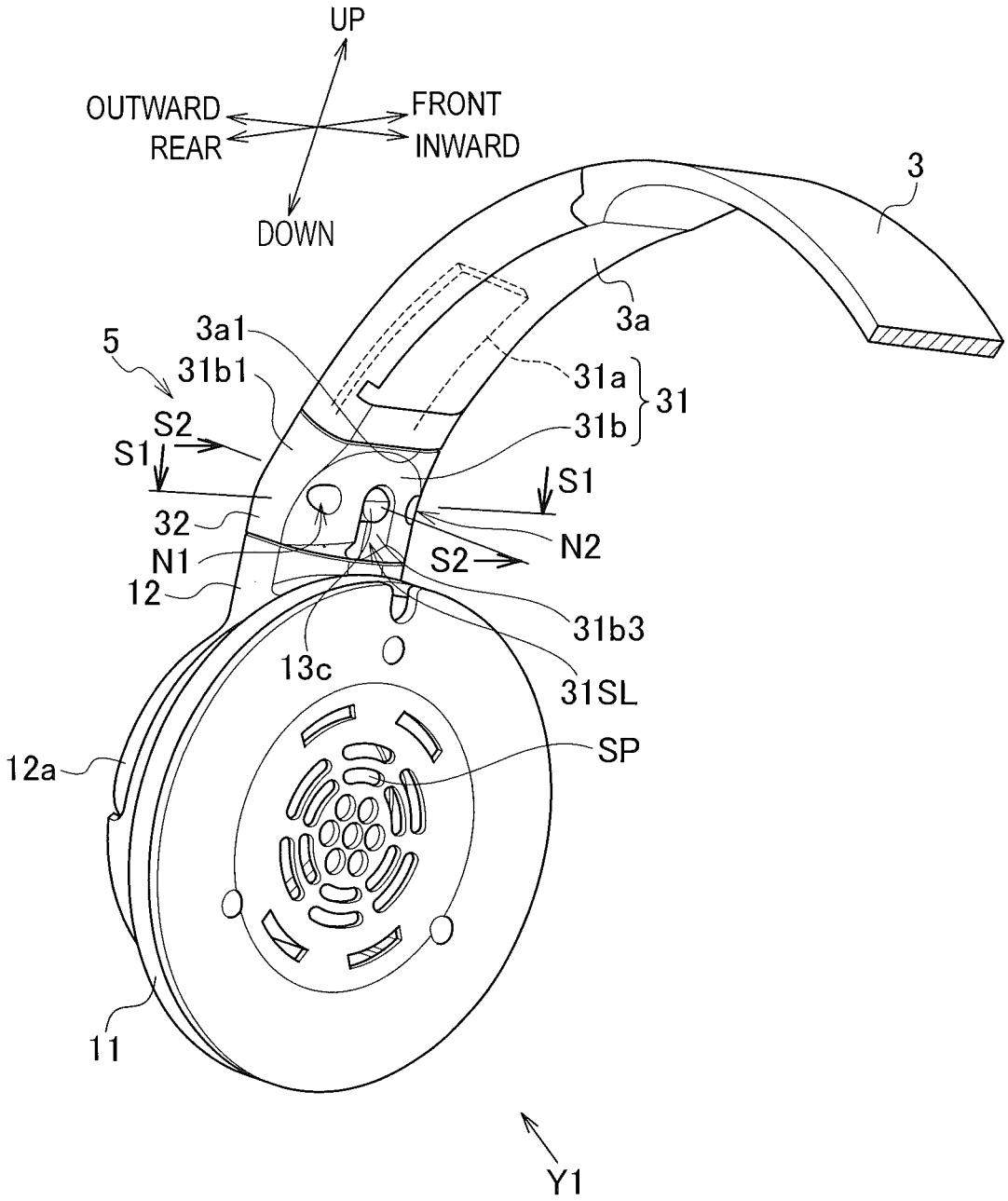
FIG. 3 is a partially-enlarged perspective view showing a link portion 5 in the headphone device 51.

FIG. 3 is an enlarged view of the link portion 5, the housing portion 1, and (a part of) the headband 3, where it is shown by removing the ear pad 4.

Figure 4:
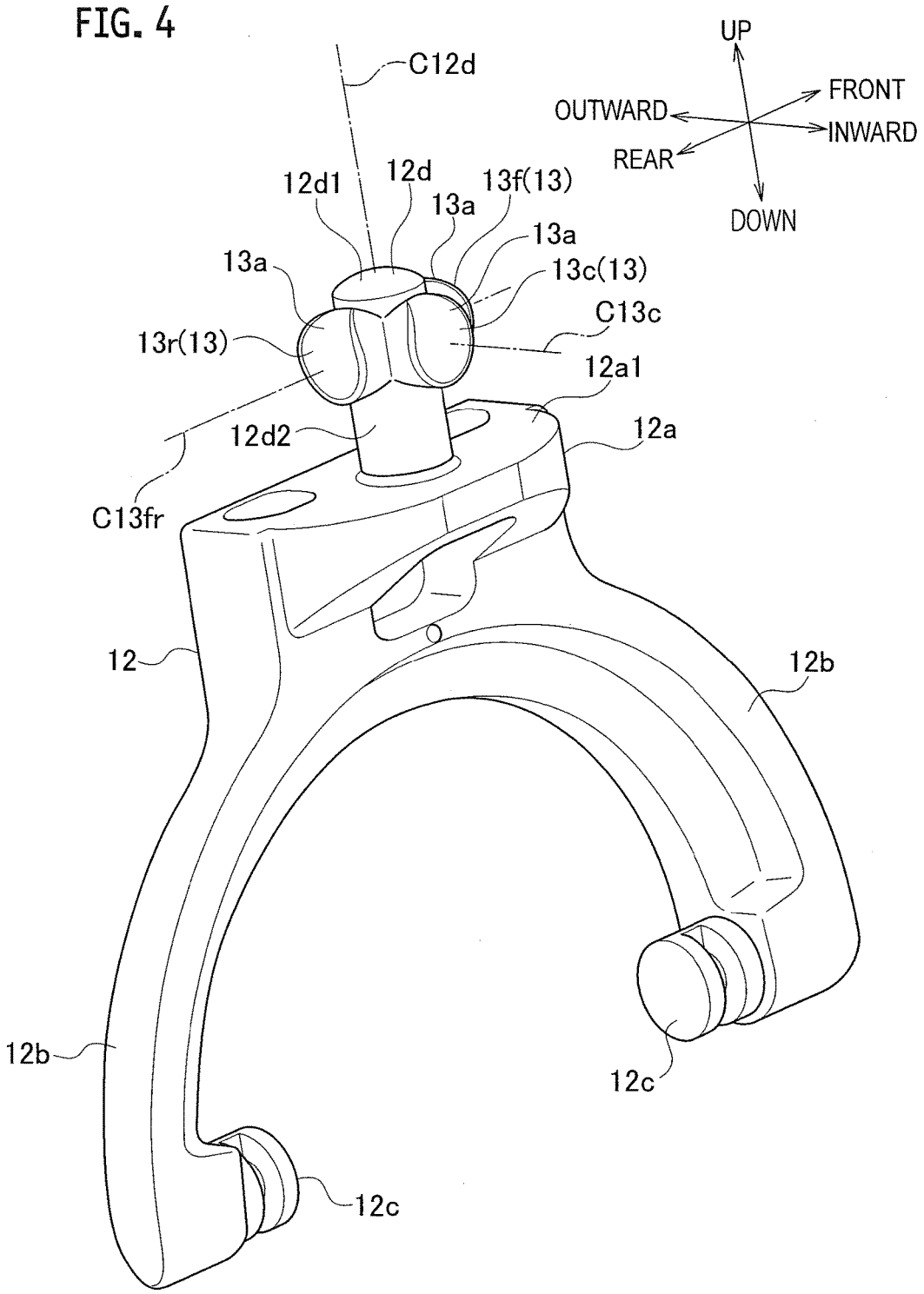
FIG. 4 is a perspective view showing a hanger 12 of the headphone device 51.

FIG. 4 is a perspective view of only the hanger 12, which is seen from the arrow Y1 direction in FIG. 3.

Figure 5:
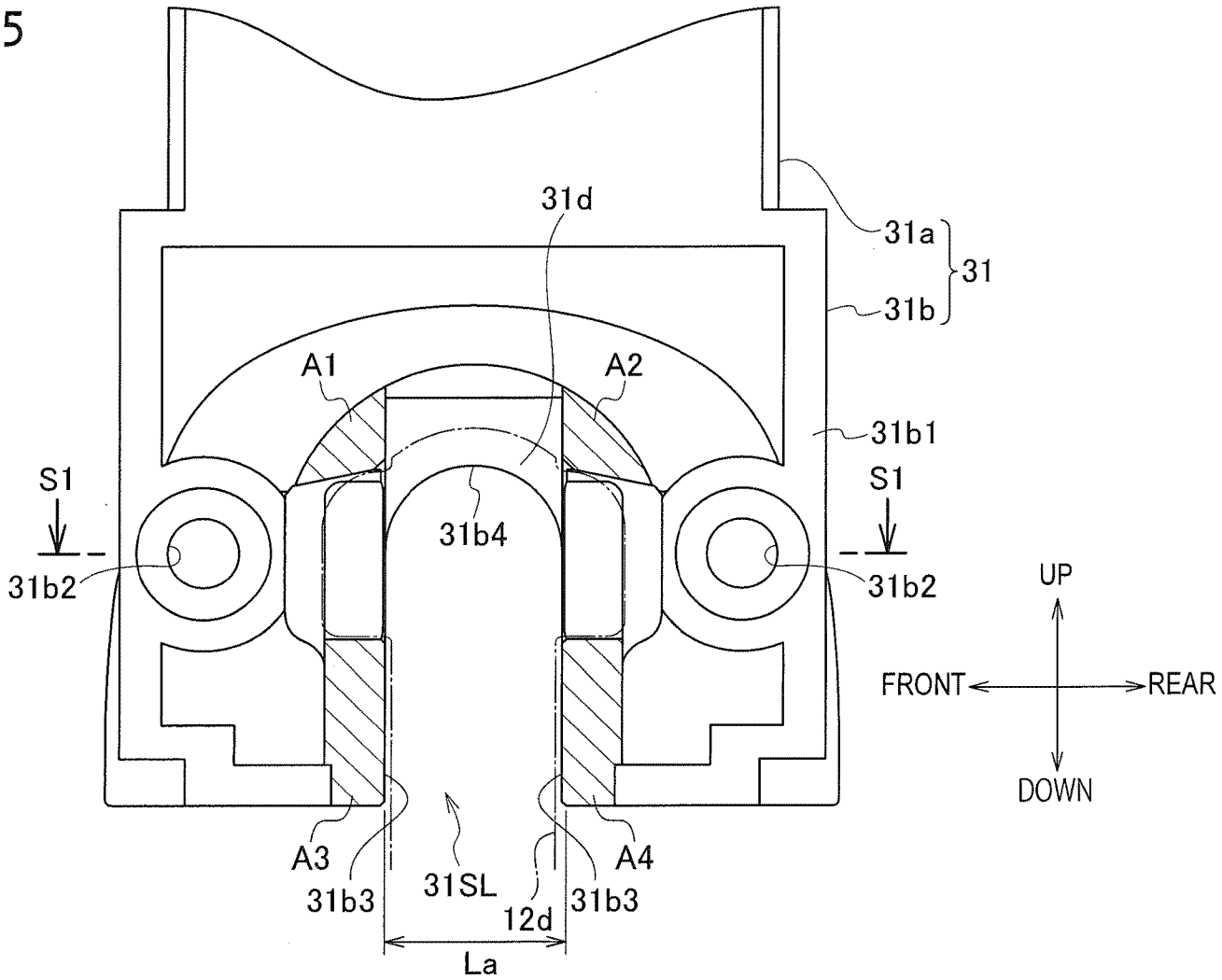
FIG. 5 is a plan view in which a slide body 31*b* of the headphone device 51 is seen from an external view.
Figure 6:
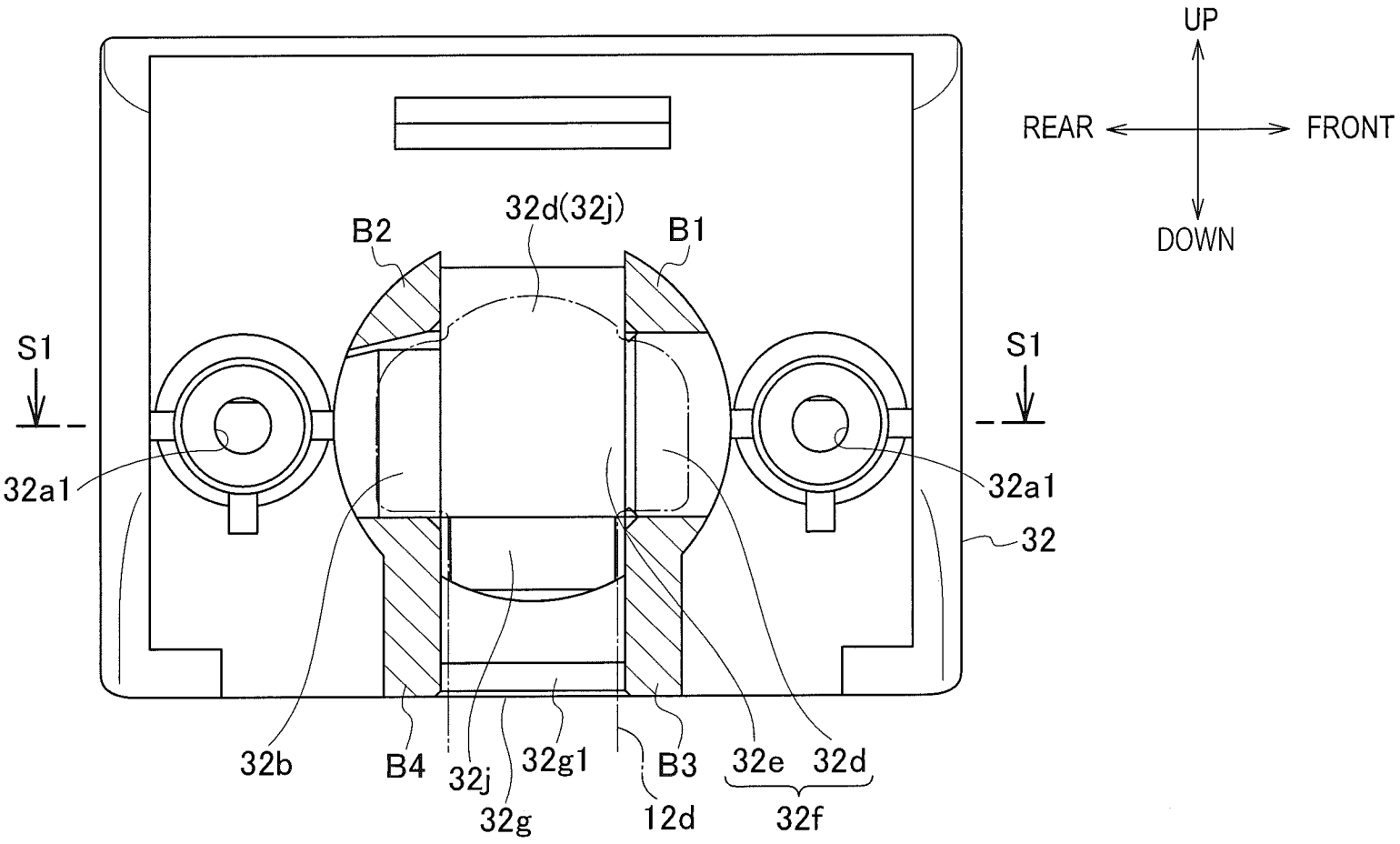
FIG. 6 is a plan view in which a cover 32 of the headphone device 51 is seen from an internal view.

FIG. 5 and FIG. 6 are partial plan views for explaining the slider 31 (FIG. 5) and the cover 32 (FIG. 6), which are members provided at the tip-end of the headband 3 that constitutes the link portion 5.

Figure 7:
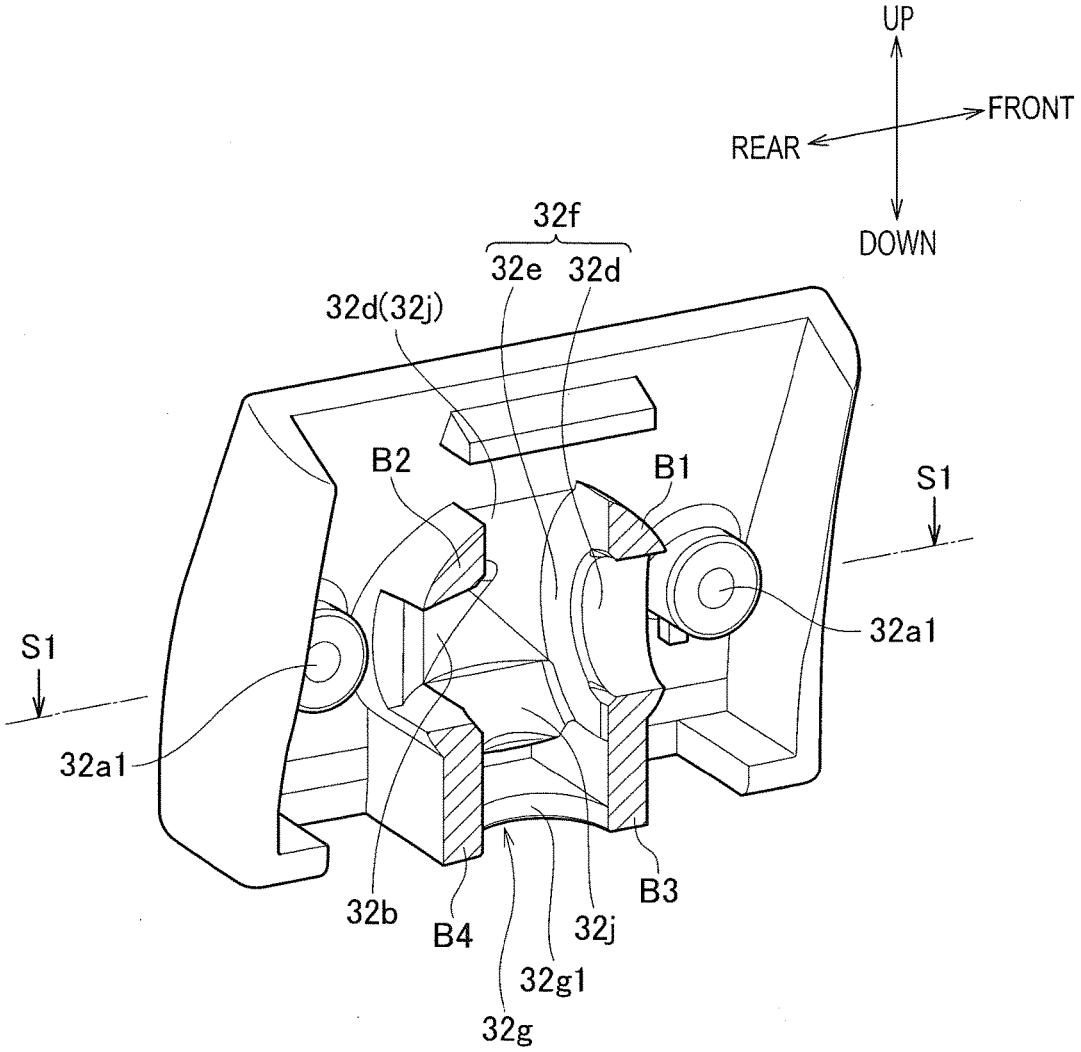
FIG. 7 is a perspective view showing the cover 32.

FIG. 7 is a perspective view for explaining the cover 32.

Figure 8:
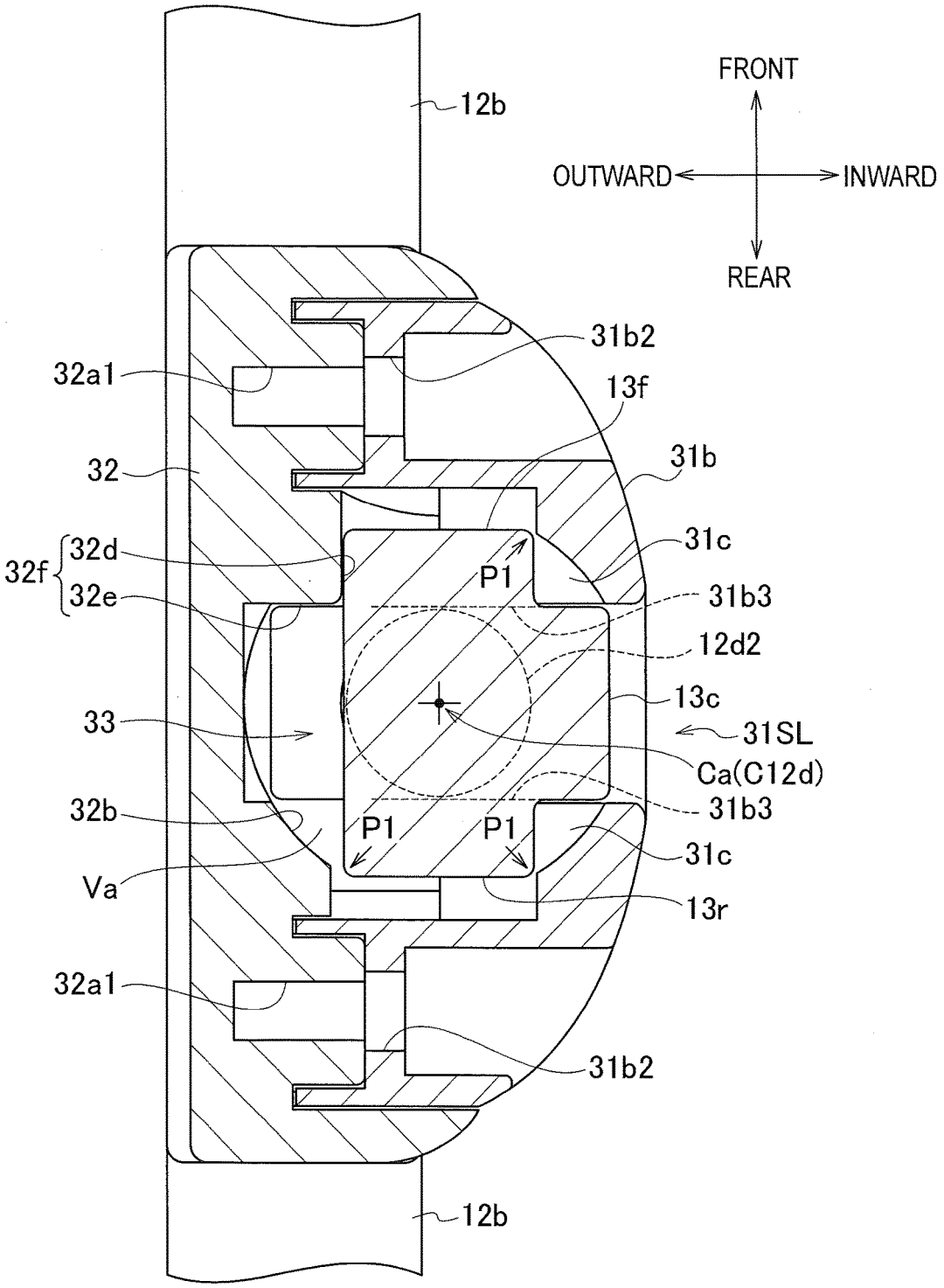
FIG. 8 is a lateral cross-sectional view in the reference usage posture for explaining a revolution operation at the link portion 5.
Figure 9:
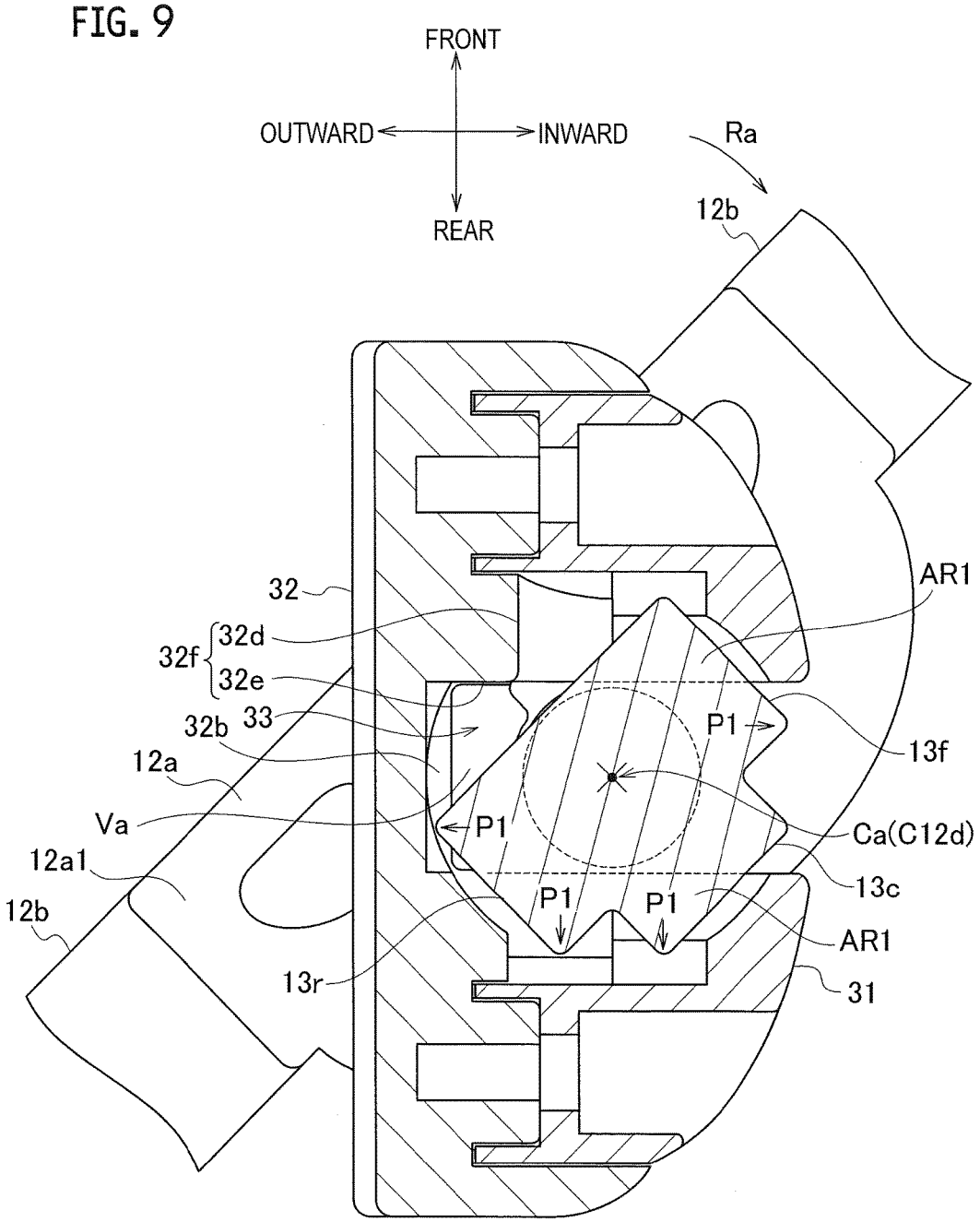
FIG. 9 is a lateral cross-sectional view in an intermediate posture for explaining a revolution operation at the link portion 5.
Figure 10:
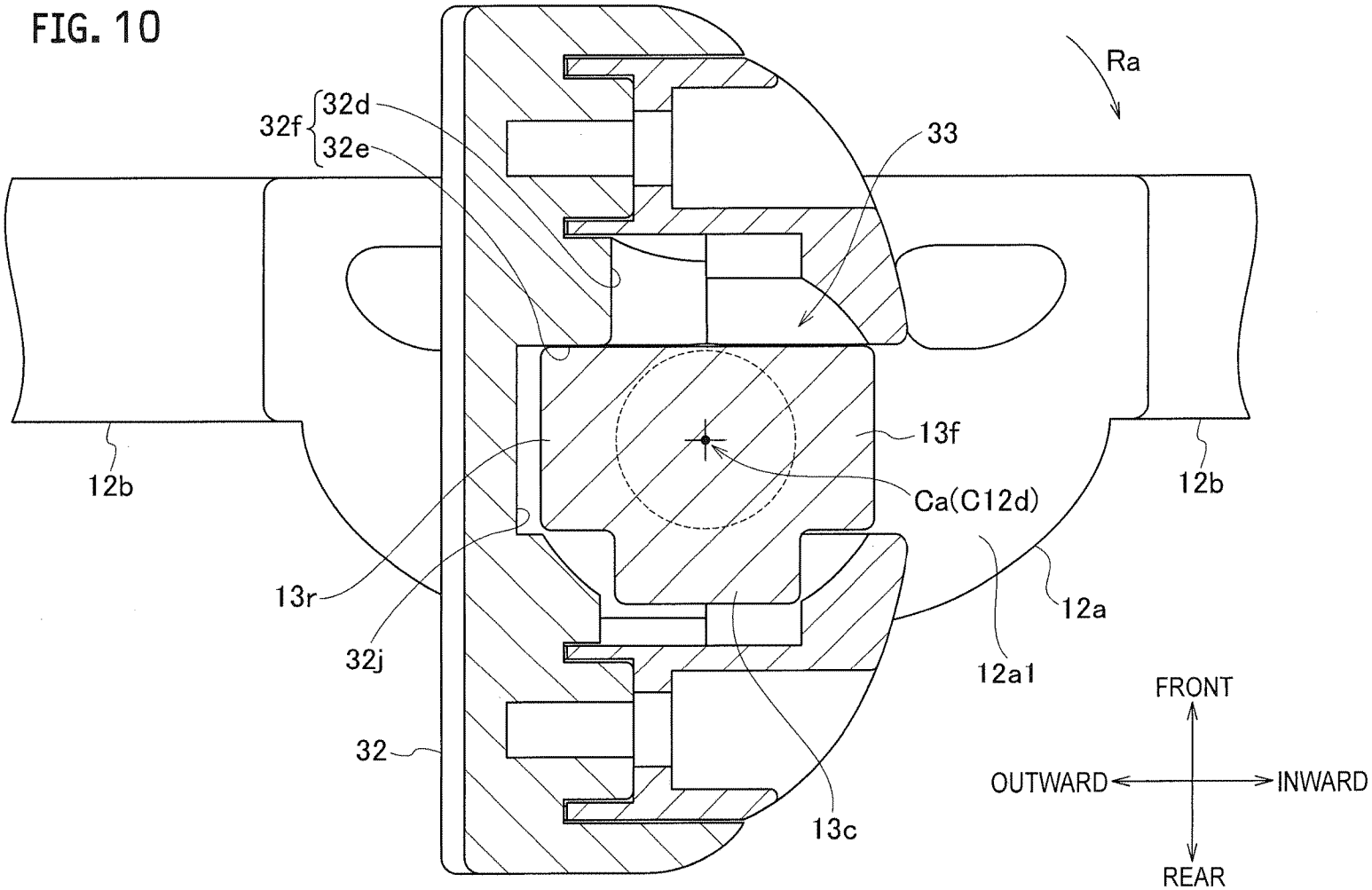
FIG. 10 is a lateral cross-sectional view in the usage B posture for explaining a revolution operation at the link portion 5.

FIG. 8 to FIG. 10 are cross-sectional views for explaining the revolution around the revolution axial line Ca, at the S1-S1 position in FIG. 3.

Figure 11:
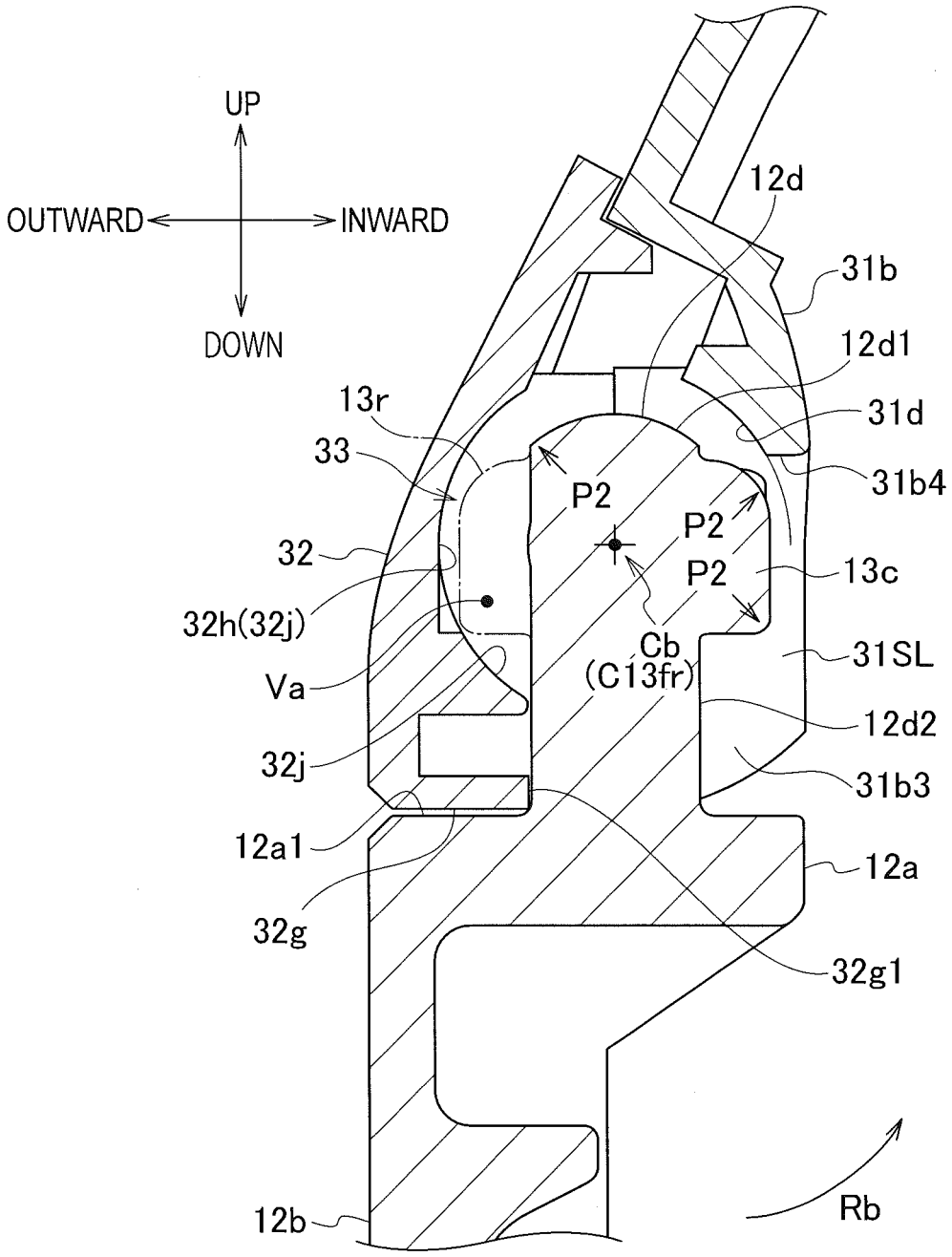
FIG. 11 is a longitudinal cross-sectional view in the reference usage posture for explaining a folding operation at the link portion 5.
Figure 12:
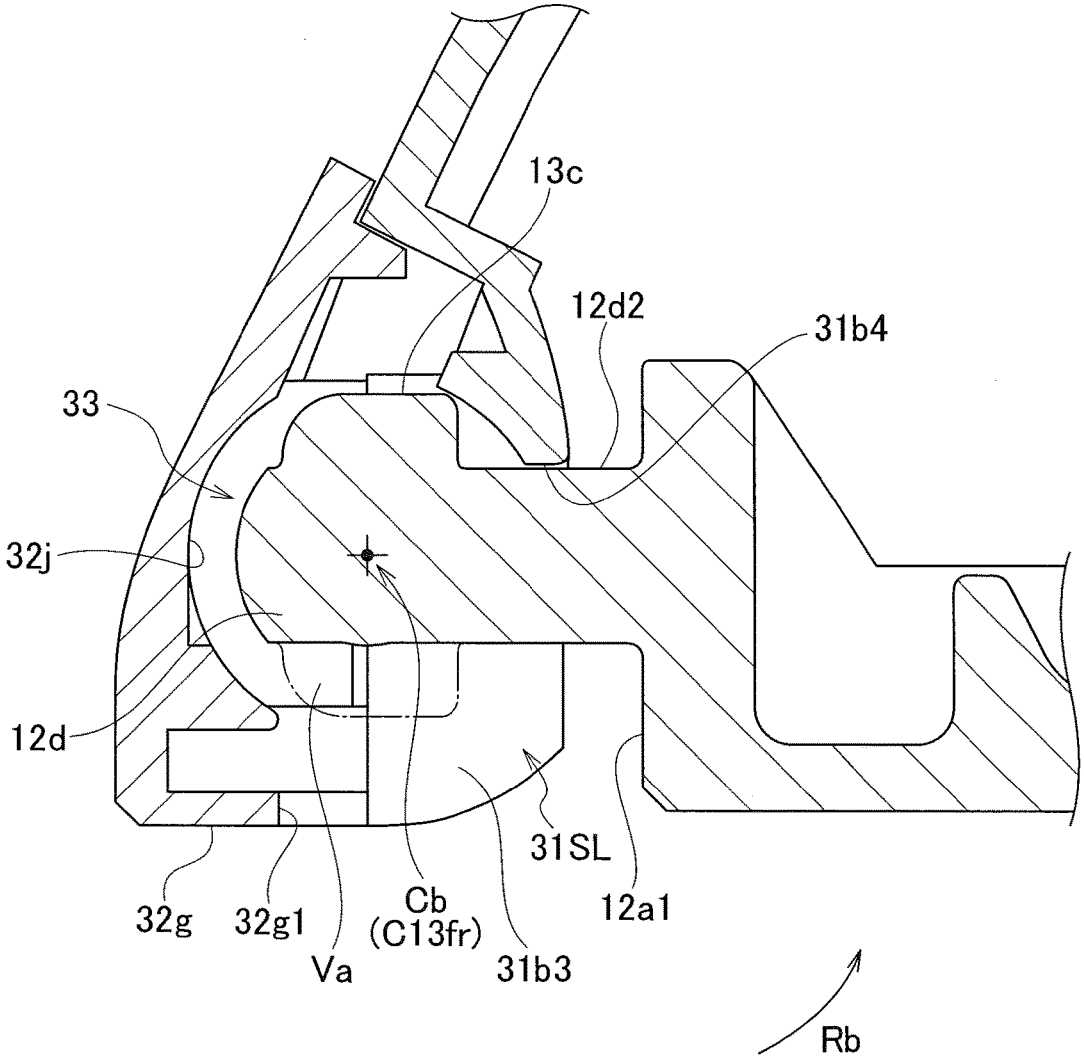
FIG. 12 is a longitudinal cross-sectional view in the accommodation A posture for explaining a folding operation at the link portion 5.

FIG. 11 and FIG. 12 are cross-sectional views for explaining the revolution around the folding axial line Cb at the S2-S2 position that is orthogonal to the S1-S1 position.

In FIG. 3 and FIG. 4, in addition to the front/rear direction specified in FIG. 1, the up/down direction and inward/outward direction are specified by arrows. These directions roughly correspond to the respective directions in the reference usage posture.

As shown in FIG. 4, the hanger 12 has abase portion 12*a*, in which an upper end portion is made to be an end face 12*a*1 that is convex in an inward direction, and a pair of arm portions 12*b* that extend in two branches in the front/rear direction downward from the base portion 12*a*.

At the tip-end portions of the arm portions 12*b*, engaging protrusions 12*c*, that are protruding to approach to and face with each other, are formed. The engaging protrusions 12*c* support the main body portion 11 by engaging with the engaging concave portions (not shown) formed on side faces of the main body portion 11.

On the end face 12*a*1, a support column 12*d* is provided to be extending upwards. A tip-end face 12*d*1 of the support column 12*d* is formed with a curved face to be roughly a part of a sphere.

Also, the support column 12*d* has the protrusion-forming portions 13 that include the protrusions 13*c*, 13*f*, and 13*r* of short column shapes that are protruding inward, frontward, and rearward at the tip-end side. The protrusion-forming portions 13 are also referred to simply as protrusions 13 in the following, in the case of not distinguishing the respective protrusions.

In the support column 12*d*, a column-shaped portion on the end face 12*a*1 side, on which the protrusions 13 are not formed, is referred to as a support column base portion 12*d*2.

A lateral cross-sectional shape of each protrusion 13 takes a roughly circular shape. In a longitudinal cross-sectional shape that sections in the up/down direction, the fillet 13*a* of an arc shape is formed on an upper side of the tip-end face. A central axial line C13*c* of the protrusion 13*c* intersects orthogonally with a central axial line C12*d* of the support column base portion 12*d*2.

A central axial line of the protrusion 13*f* and a central axial line of the protrusion 13*r* are coinciding and set as a common central axial line C13*fr*. The central axial line C13*fr* intersects orthogonally with the central axial line C12*d* of the support column base portion 12*d*2 and the central axial line C13*c* of the protrusion 13*c*.

That is, the three central axial lines C12*d*, C13*c*, and C13*fr* are set to be orthogonal with one another and intersect at one point.

Consequently, the protrusion 13*f* and the protrusion 13*r* protrude in opposite directions with each other along the central axial line C13*fr*.

The central axial line C12*d* is set to coincide with the revolution axial line Ca, when the headphone device 51 is assembled by assembling the hanger 12 together with the headband 3 and the like. Similarly, the central axial line C13*fr* is set to coincide with the folding axial line Cb in the headphone device 51.

In FIG. 3, the headband 3 includes a base portion 3*a* of a thin plate shape which has an elasticity and is curved along a single plane extending in the up/down and inward/outward directions, and a slider 31 to be freely drawn by sliding from an end portion 3*a*1 of the base portion 3*a*.

That is, in FIG. 3, an extended plane of the headband 3 is in the up/down and inward/outward directions, and the housing portion 1 takes a posture that is roughly orthogonal to this extended plane in the reference usage posture.

The slider 31 has a slider piece 31*a* that is inserted into the base portion 3*a*, and a slider main body 31*b* that constitutes the link portion 5 by being exposed from the end portion 3*a*1 of the base portion 3*a*.

The link portion 5 is configured by including the slider main body 31*b*, the cover 32 that covers the outside face 31*b*1 of the slider main body 31*b* from outward and that is fixed by screws N1 and N2, and the hanger 12 having the support column 12*d* that is present in a space of a prescribed shape which is formed between the slider main body 31*b* and the cover 32.

FIG. 5 is a view of the slider main body 31*b* seen from the outward side. The pair of holes 31*b*2 are piercing holes for inserting the male screws N1 and N2.

Four hatched portions A1-A4 in FIG. 5 are not cross sections, but portions protruding to the front side of the paper rather than their surrounding portions, which are formed such that their tip-end faces are contained in the same plane.

In the slider main body 31*b*, a slit 31SL of an inverted U-shape is formed reaching to a vicinity of a central portion in the up/down direction from a lower face. The front/rear opposing faces 31*b*3 and 31*b*3 of the slit 31SL are formed to be parallel with each other by being separated by the constant distance La. An uppermost portion of the slit 31SL is made to be an abutting portion 31*b*4 of a semicircular shape.

On the other hand, the cover 32 is shown in FIG. 6 and FIG. 7. FIG. 6 is a view of the cover 32 seen from the inward side, and FIG. 7 is a perspective view seen from an obliquely rear upper side of the inward side. The pair of holes 32*a*1 are bottom holes for the taps of the screws N1 and N2.

Four hatched portions B1-B4 in FIG. 6 and FIG. 7 are not cross sections, but portions that protrude to the front side of the paper rather than the other portions, which are formed such that their tip-end faces are contained in the same plane.

When the cover 32 is fixed to the slider main body 31*b* by the screws N1 and N2, the portions B1-B4 are respectively abutted or coming close to the portions A1-A4, and an accommodation space Va (shown in FIG. 8, etc.), which is roughly combining columns in a cross shape, is formed by concave portions between the respective portions B1-B4.

That is, an accommodation portion 33 (shown in FIG. 8, etc.) having the accommodation space Va is formed by the slider main body 31*b* and the cover 32. The shape of the accommodation space Va roughly corresponds to the shape of the support column 12*d* so that the support column 12*d* can be engaged and accommodated.

The accommodation space Va may not cover the support column 12*d* completely, and a part of the support column 12*d* may be exposed. In this example, a part of the protrusion 13*c* and the support column base portion 12*d*2 is exposed to the outside.

In FIG. 5 and FIG. 6, a schematic outward appearance of the support column 12*d* in the reference usage posture is shown by a dotted chain line.

The link portion 5 is assembled by mounting the support column 12*d* of the hanger 12, in a posture that is to be the reference usage posture, to the concave portions in a cross shape of the slider main body 31*b* that forms the accommodation space Va, attaching and fixing the cover 32 with the male screws N1 and N2.

The accommodation portion 33 is formed such that the revolution of the support column 12*d* (the hanger 12) by a prescribed angle around the revolution axial line Ca is permitted, and the revolution of the support column (the hanger 12) by a prescribed angle around the folding axial line Cb is permitted. Details of these revolutions will be described sequentially.

<Revolution Around the Revolution Axial Line Ca>

FIG. 8 to FIG. 10 are cross-sectional views at the S1-S1 position in FIG. 1 for explaining the revolution of the hanger around the revolution axial line Ca. The position corresponding to the cross-sectional position S1-S1 is also indicated in FIG. 5 and FIG. 6.

The accommodation portion 33 permits the revolution of the protrusions 13 in a clockwise direction with respect to the revolution axial line Ca, for the reference usage posture shown in FIG. 8. That is, the inner face 31*c* of a curved surface shape is formed in the slider main body 31*b*, and the inner face 32*b* of a curved surface shape is formed in the cover 32, corresponding to a trace in a clockwise direction so that there is no interference with a position P1 that provides a maximum diameter of the protrusions 13.

In the case where lengths of the protrusions 13*c*, 13*f*, and 13*r* are set equal, the distance from the revolution axial line Ca to a distal tip of each protrusion becomes equal, so that the accommodation space for making the inner face 31*c* and the inner face 32*b* to be non-interfering with the protrusions 13 can be made smallest, and the entire structure of the link portion 5 can be made compact.

On the other hand, in the case where lengths of the protrusions 13*c*, 13*f*, and 13*r* are set differently, it suffices to form the inner face 31*c* and the inner face 32*b* with a protrusion for which the distance to a portion that is farthest from the revolution axial line Ca is longest among these protrusions as a reference.

In FIG. 8, the movement in the front/rear direction of the hanger 12 is regulated as the support column base portion 12*d*2 abuts the opposing faces 31*b*3 of the slit 31SL. In FIG. 8, the revolution in a counterclockwise direction is made to be regulated as the protrusion 13*f* abuts a regulating face 32*d* provided in the cover 32.

FIG. 9 shows a state in which the hanger 12 is revolved by about 45° in the clockwise direction (arrow Ra) around the revolution axial line Ca. As shown in FIG. 9, there is no portion for regulating the revolution of the support column 12*d* at this revolution position, so that a further revolution in the clockwise direction is possible.

FIG. 10 shows a state in which the hanger 12 is revolved by about 90° in the clockwise direction (arrow Ra) around the revolution axial line Ca. As shown in FIG. 10, the cover 32 is provided with a regulating face 32*e* that abuts an upper face in FIG. 10 of the protrusion 13*f*, so that a further revolution of the hanger 12 in the clockwise direction is prohibited by that abutting.

In the cover 32, a regulating convex portion 32*f* having the regulating face 32*d* and the regulating face 32*e* is formed on the inner face. One of the regulating faces 32*d* and 32*e* functions as the first revolution regulating portion, while another one of the regulating faces 32*d* and 32*e* functions as the second revolution regulating portion.

In this way, the revolutions of the hanger 12 around the revolution axial line Ca in the clockwise direction and the counterclockwise direction are regulated. In other words, a revolution permitted range of the hanger 12 is set by the regulating convex portion 32*f*.

In the assembled link portion 5, the support column 12*d* accommodated in the accommodation space Va of the accommodation portion 33 has its downward movement regulated as the portions A3 and B3 shown in FIG. 5 and FIG. 6 abut the protrusion 13*f*, and the portions A4 and B4 abut the protrusion 13*r*.

In addition, the upward movement of the support column 12*d* is regulated as the upper end face 12*a*1 of the base portion 12*a* abuts the lower end face 32*g* of the cover 32 (also refer to FIG. 6).

In this way, the hanger 12 is prevented from dropping or disengaging from the link portion 5.

<Revolution Around the Folding Axial Line Cb>

FIG. 11 and FIG. 12 are cross-sectional views at the S2-S2 position in FIG. 1 for explaining the revolution of the hanger 12 around the folding axial line Cb. The reference usage posture is shown in FIG. 11, and the accommodation A posture is shown in FIG. 12.

In the slider main body 31*b*, the slit 31SL is formed, having a width passable by the support column base portion 12*d*2 of the support column 12*d*. Also, in the accommodation portion 33, the inner face 31*d* of a concave curved surface shape is formed on the slider main body 31*b*, and the inner face 32*h* of a concave curved surface shape is formed on the cover 32, corresponding to the trace of a position P2 in the counterclockwise direction in FIG. 11, such that there is no interference with the position P2 that provides a maximum diameter of the support column 12*d* (including the protrusion 13*c*) from the folding axial line Cb.

In this way, the revolution of the hanger 12 in the counterclockwise direction (arrow Rb) is permitted in FIG. 11, with respect to the folding axial line Cb from the reference usage posture.

On the other hand, the revolution in the clockwise direction around the folding axial line Cb is regulated as the support column base portion 12*d*2 abuts the inner end portion 32*g*1 of the lower end face 32*g* (also refer to FIG. 6).

FIG. 12 shows a state in which the hanger 12 (the housing portion 1) is revolved by about 90° in the counterclockwise direction from a state of FIG. 11. In this state, the revolution in the counterclockwise direction is regulated as the support column base portion 12*d*2 abuts the abutting portion 31*b*4 of the slit 31SL.

A revolution permitted range in the counterclockwise direction around the folding axial line Cb is set by a position of the inner end portion 32*g*1 of the lower end face 32*g* of the cover 32, and a deepest portion (a position of the abutting portion 31*b*4) of the slit 31SL in the slider main body 31*b*. One of the inner end portion 32*g*1 and the abutting portion 31*b*4 functions as the first folding revolution regulating portion, and the other one of the inner end portion 32*g*1 and the abutting portion 31*b*4 functions as the second folding revolution regulating portion.

In this folding revolution, the support column 12*d* is made to be guided in the revolution as the portions A1, B1, A3, and B3 abut a circumferential face of the protrusion 13*f*, and the portions A2, B2, A4, and B4 abut a circumferential face of the protrusion 13*r*.

That is, the support column 12*d* is supported to be freely-revolvable only around the folding axial line Cb at two locations that are separated with the support column base portion 12*d*2 in between, along the folding axial line Cb.

For this reason, the folding revolution of the hanger 12 from the reference usage posture to the accommodation A posture becomes very smooth as one that has a sense of high quality, as slips are suppressed.

Here, in the link portion 5, either one of the permission and the regulation of the revolution around the folding axial line Cb is selected by the revolution position around the revolution axial line Ca of the hanger 12 (the housing portion 1) between the reference usage posture and the usage B posture. That is, in the case where the housing portion 1 is in the reference usage posture, the revolution around the folding axial line Cb is permitted as described above.

Also, in the usage B posture in which the housing portion 1 is revolved by about 90° around the revolution axial line Ca, the revolution around the folding axial line Cb is permitted. That is, even in the usage B posture in which the hanger 12 is revolved around the folding axial line Cb in the state shown in FIG. 10, there is a protrusion route 32*j* that is formed in the cover 32 as a concave portion in a circumferential face shape, so that there is no interference with the protrusion 13*r*.

In the folding revolution from the usage B posture to the accommodation B posture, the support column 12*d* has the portions A2, B2, A4, and B4 abutting the circumferential face of the protrusion 13*c*, and the support column base portion 12*d*2 passing in such a way that both faces are sandwiched between the opposing faces 31*b*3 of the slit 31SL.

That is, the support column 12*d* is supported to be freely-revolvable only around the folding axial line Cb, while slipping at an angle with respect to the revolution axial line Ca and slips in the front/rear direction are suppressed, by the slider main body 31*b* and the cover 32.

For this reason, the folding revolution of the hanger 12 from the usage B posture to the accommodation B posture becomes very smooth as one that has a sense of high quality, as slips are suppressed.

On the other hand, in the case where the housing portion 1 is in a revolution position between the reference usage posture and the usage B posture (the revolution position shown in FIG. 9, which will be referred to as an intermediate position in the following), if an attempt to revolve it around the folding axial line Cb is made, no space for revolving it and passing without any interference with the protrusion 13*f* and the protrusion 13*r* is formed at the intermediate position as the accommodation space Va.

More specifically, if an attempt to revolve it around the folding axial line Cb is made from the intermediate position shown in FIG. 9, portions of the protrusion 13*f* and the protrusion 13*r* that are protruding from the opening width of the slit 31SL (portions indicated by AR1 in FIG. 9) cause interference, as the protrusion 13*f* interferes with the portions A1 and B1, and the protrusion 13*r* interferes with the portions A4 and B4. In this way, the revolution of the housing portion 1 around the folding axial line Cb is regulated.

Also, it is made such that the revolution of the housing portion 1 around the revolution axial line Ca is permitted only when the housing portion 1 is in the reference usage posture. That is, in a middle position of the folding revolution from the reference usage posture and in the accommodation A posture, it is made such that the revolution of the support column 12*d* is regulated around the central axial line C12*d* that corresponds to the revolution of the hanger 12 around the revolution axial line Ca.

This is due to the fact that in the middle position of the folding revolution from the reference usage posture and in the accommodation A posture, if an attempt is made to revolve the hanger 12 around anything other than the folding axial line Cb, it is made such that such a revolution is regulated as the protrusion 13*f* and the protrusion 13*r* abut any of the portions A1-A4 and the portions B1-B4.

Also, if an attempt is made to revolve the hanger 12 around the central axial line C12*d* of the support column 12*d*, it is made in a way that such a revolution is regulated, as the protrusion 13*c* abuts the opposing faces 31*b*3 because the protrusion 13*r* has been entering into the slit 31SL.

The hanger 12, the slider main body 31*b*, and the cover 32 can be formed by thermoplastic resin, for example, but it is not limited to thermoplastic resin. An example of using the screws N1 and N2 for fixing the slider main body 31*b* and the cover 32 has been described, but the method of fixing is not limited to that of using the screws. They may be fixed by other methods such as welding or adhesion.

According to the headphone device 51 described in detail above, the revolution axial line Ca for the revolution of the housing portions 1 and 2 by about 90° between the reference usage posture and the usage B posture and the folding axial line Cb for the folding revolution by about 90° in these postures are set to be intersecting, and it is made such that the revolutions around these axial lines Ca and Cb can be performed by a common single revolution mechanism.

Consequently, while it can be folded compactly, the length of the folded portion can be made short, and the pair of the housing portions 1 and 2 are unlikely to interfere when folded so that there are fewer constraints on the outward appearance designs. Also, it suffices to provide a single revolution mechanism, so that the number of parts is less and it becomes inexpensive.

The present invention is not to be limited to the configuration described above, and can be modified in a range that does not digress from the essence of the present invention.

The revolution angle range around the revolution axial line Ca and the folding revolution angle range around the folding axial line Cb are not limited to about 90° described above, and may be set appropriately.

The protrusions 13*c*, 13*f*, and 13*r* are not limited to those for which the lateral cross-sectional shape is circular. For example, they may be those for which the lateral cross-sectional shape is polygonal and the like.

The regulating face 32*d* and the regulating face 32*e* may not be provided on the cover 32 side, and may be provided on the slider main body 31*b* side. They may be provided on both sides.

The headphone device 51 may not be equipped with both of the housing portions 1 and 2. It may be of a type for single ear use that is equipped with only one housing portion.

The main body portion 11 may be capable of revolving by a prescribed angle (for example, about 180°) in the Rc direction from the posture shown in FIG. 1. Also, the headband 3 itself may be capable of being folded into the inner side of a curved portion by providing a hinge at the intermediate portion of the headband 3. In this way, further compact folding becomes possible.

The protrusions 13 in the embodiment described above have a fillet formed at the edge portion of the tip-end face 12*d*1 side of the support column 12*d*, but the tip-end face of each protrusion 13 may be formed by a curved face to be roughly a part of a sphere, similarly as the tip-end face 12*d*1 of the support column 12*d* in order to shorten the distance to the edge portion with no fillet formed, for which the distance from the revolution axial line Ca becomes longer.

In this way, the distance from the revolution axial line Ca to the distal portion of the tip-end face of each protrusion 13 becomes shorter, and the volume of the accommodation space Va becomes smaller. For this reason, the entire configuration of the link portion 5 can be made compact, and it is possible to revolve the hanger 12 with fewer slips.

In the case where the protrusions 13 are made to be of column shapes, their diameters may not necessarily be the same diameter as one another.

What is claimed is:

1. A headphone device comprising:

a headband;

a housing portion having a speaker unit, a main body portion accommodating the speaker unit, and a hanger supporting the main body portion; and a link portion to which the hanger is linked at an end portion of the headband, wherein the hanger comprises a base portion, and a support column having a support column base portion provided to be erected from the base portion, and a plurality of protrusions formed on a tip-end side of the support column;

the plurality of protrusions comprise a first protrusion and a second protrusion formed to be protruding in opposite directions with each other on a second axial line that intersects orthogonally with a first axial line which is an axial line of the support column base portion, and a third protrusion formed to be protruding on a third axial line that intersects orthogonally with the first axial line and the second axial line;

the link portion comprises an accommodation portion for engaging and accommodating the first, second and third protrusions; and the hanger is linked with the link portion as the first, second and third protrusions are engaged with and accommodated in the accommodation portion, such that a revolution within a first prescribed angle range around the first axial line of the support column is permitted, and a folding revolution that is a revolution within a second prescribed angle range around the second axial line of the support column is permitted when the support column is located at either one of both ends of the first prescribed angle range.

2. The headphone device according to claim 1, wherein the accommodation portion comprises:

a first revolution regulating portion that abuts with one of the first protrusion or the second protrusion, when the support column is revolved in one direction around the first axial line; and a second revolution regulating portion that abuts with another one of the first protrusion or the second protrusion, when the support column is revolved in another direction, wherein the first prescribed angle range is set by the first and second revolution regulating portions.

3. The headphone device according to claim 1, wherein the accommodation portion comprises:

a first folding revolution regulating portion with which the support column base portion abuts by the folding revolution in one direction around the second axial line, when the support column is located at a revolved position at either one of both ends of the first prescribed angle range; and a second folding revolution regulating portion with which the support column base portion abuts by the folding revolution in another direction, wherein the second prescribed angle range is set by the first and second folding revolution regulating portions.

4. The headphone device according to claim 2, wherein the link portion comprises a first member and a second member to be combined at faces parallel to planes containing the first axial line and the second axial line, the accommodation portion is formed in an interior with a state in which the first member and the second member are combined; and the first and second revolution regulating portions are provided on one of the first member or the second member.

5. The headphone device according to claim 3, wherein the link portion comprises a first member and a second member to be combined at faces parallel to planes containing the first axial line and the second axial line;

the accommodation portion is formed in an interior with a state in which the first member and the second member are combined; and the first and second folding revolution regulating portions are provided on both of the first member and the second member.

6. The headphone device according to claim 1, wherein the first axial line is set parallel to an extended plane of the headband, and the second axial line is set to be orthogonal to the extended plane when a revolved position of the support column is at one end side of the first prescribed angle range, and set to be parallel to the extended plane when a revolved position of the support column is at another end side of the first prescribed angle range.

* * * * *